US006713724B1

(12) United States Patent
Carr et al.

(10) Patent No.: US 6,713,724 B1
(45) Date of Patent: Mar. 30, 2004

(54) HEATING ELEMENT ARRANGEMENT FOR AN ELECTRIC BLANKET OR THE LIKE

(75) Inventors: Sheldon P. Carr, West Bend, WI (US); Richard Zimmerer, Charlotte, NC (US)

(73) Assignee: Perfect Fit Industries, Inc., Charlotte, NC (US)

( * ) Notice: Subject to any disclaimer, the term of this patent is extended or adjusted under 35 U.S.C. 154(b) by 0 days.

(21) Appl. No.: 10/269,454

(22) Filed: Oct. 11, 2002

(51) Int. Cl.[7] ..... H05B 1/00

(52) U.S. Cl. ..... 219/212; 219/211; 219/529; 219/549

(58) Field of Search ..... 219/212, 211, 219/217, 528, 529, 544, 545, 549; 392/425, 432, 435

(56) References Cited

U.S. PATENT DOCUMENTS

| | | | | |
|---|---|---|---|---|
| 774,623 | A | * 11/1904 | Wales | 219/212 |
| 4,315,141 | A | * 2/1982 | Mills et al. | 219/212 |
| 4,430,560 | A | * 2/1984 | Mills et al. | 219/212 |
| 4,577,094 | A | * 3/1986 | Mills | 219/212 |
| 4,585,922 | A | * 4/1986 | Berenson | 219/212 |
| 4,677,281 | A | * 6/1987 | Mills | 219/212 |
| 5,484,983 | A | 1/1996 | Roell | |
| 5,770,836 | A | 6/1998 | Weiss | |
| 5,801,914 | A | 9/1998 | Thrash | |
| 5,824,996 | A | 10/1998 | Kochman et al. | |
| 5,861,610 | A | 1/1999 | Weiss | |
| 6,057,530 | A | 5/2000 | Gurevich | |
| 6,078,026 | A | 6/2000 | West | |
| 6,084,206 | A | 7/2000 | Williamson et al. | |
| 6,097,009 | A | 8/2000 | Cole | |
| 6,172,344 | B1 | 1/2001 | Gordon et al. | |
| 6,177,658 | B1 | 1/2001 | White et al. | |
| 6,222,162 | B1 | 4/2001 | Keane | |
| 6,229,123 | B1 | 5/2001 | Kochman et al. | |
| 6,310,332 | B1 | 10/2001 | Gerrard | |
| 6,326,596 | B1 | 12/2001 | O'Leary et al. | |
| 6,369,369 | B2 | 4/2002 | Kochman et al. | |
| 6,388,237 | B1 | 5/2002 | Miyahara et al. | |
| 6,392,209 | B1 | 5/2002 | Oppitz | |
| 6,403,935 | B2 | 6/2002 | Kochman et al. | |
| 6,414,286 | B2 | 7/2002 | Rock et al. | |
| 2002/0117495 | A1 | 8/2002 | Kochman et al. | |
| 2002/0121887 | A1 | 9/2002 | Inatomi et al. | |
| 2002/0122319 | A1 | 9/2002 | Mobers et al. | |
| 2002/0122323 | A1 | 9/2002 | Nagaya et al. | |

* cited by examiner

*Primary Examiner*—Henry Bennett
*Assistant Examiner*—Fadi H. Dahbour
(74) *Attorney, Agent, or Firm*—Boyle, Fredrickson, Newholm, Stein & Gratz, S.C.

(57) ABSTRACT

An electrically operated heating device, such as an electric blanket, mattress pad, heating pad or throw having a pliable member, includes heating elements located within an interior defined by the pliable member which are configured to prevent breakage or disconnection of the heating elements in the event the pliable member is subjected to a concentrated load that applies tension to the heating elements. The interior of the pliable member includes a series of passages within which the heating elements are located. The heating elements have a non-linear configuration such that the overall length of the heating element contained within each passage has a length greater than that of the passage, which enables the heating elements to stretch and flex when the blanket portion is subjected to a concentrated load. The ends of adjacent heating elements are connected, such that the heating elements are defined by a single length of heating wire that is placed in a back and forth manner throughout the surface area of the blanket portion. The heating wire defines ends which are engaged with a power input for supplying electrical power to the heating elements.

17 Claims, 3 Drawing Sheets

HEATING ELEMENT ARRANGEMENT FOR AN ELECTRIC BLANKET OR THE LIKE

BACKGROUND AND SUMMARY OF THE INVENTION

This invention relates to a pliable member incorporating an electrically operated heating element, such as an electric blanket, mattress pad, heating pad or the like, and more particularly to an arrangement for positioning a heating element within the pliable member so as to prevent the adverse consequences that can result from exposure of the heating element to tensile forces or other conditions that can cause strain on the heating element.

A pliable electric heating member, such as an electric blanket, mattress pad, heating pad, throw or the like, typically includes a soft pliable outer member or shell formed of two layers between which one or more heating elements, such as resistive heating wires, are located. In a typical construction, the heating wires are generally parallel and spaced apart from each other, and are maintained in place via a stitching arrangement or a web-type material secured to one of the layers about each heating wire. Each heating wire is supplied with electrical power from a power supply, and the resistance of the heating wires functions to generate heat to provide a warm environment for the user of the electric blanket, heating pad or throw.

In a conventional construction, the heating wires are arranged in a linear orientation parallel to each other. While this type of heating wire configuration provides satisfactory operation, it involves certain disadvantages in that the heating wires have little or no "give". This can result in the heating wires becoming broken or disconnected from the power input of the pliable heating member, such as when a concentrated load (e.g. a user's elbow or knee) is applied to a portion of the pliable member within which the heating wire is located, which results in application of tensile forces to the heating wires. Such breaking of the heating wires or disconnection of the heating wires from the power input can occur in any condition that causes stretching of the blanket material, and thereby the heating elements, beyond the capability of the heating wires to accommodate the tensile forces applied to the heating wires.

It is an object of the present invention to provide a heating element arrangement for a pliable heating member such as an electric blanket, mattress pad, heating pad, throw or the like which eliminates the adverse consequences associated with the heating element being subjected to tensile forces, which can result from application of concentrated loads to the pliable heating member. It is a further object of the invention to provide such a heating element arrangement which provides even distribution of heat throughout the area of the pliable heating member within which the heating element is contained. It is a further object of the invention to provide such a heating element arrangement which provides little or no additional cost of materials or in labor associated with manufacture of the pliable heating member. It is a further object of the invention to provide such a heating element arrangement which can be incorporated into the pliable heating member in various ways.

In accordance with the present invention, a heating device such as an electric blanket, mattress pad, heating pad or throw, includes a pliable member having first and second oppositely facing surfaces, and at least one elongated heating element located between the first and second oppositely facing surfaces. The pliable member defines a series of passages, and an elongated heating element is located within each passage. The elongated heating element in each passage has a non-linear configuration, such that the overall length of the elongated heating element contained within the passage exceeds the length of the passage. In this manner, application of a concentrated load to the pliable member, which normally results in the elongated heating elements experiencing a tensile force, enables the heating elements to flex and stretch within the passages to prevent the adverse effect on the heating elements caused by application of tensile forces to the heating elements, such as breakage or disconnection from the power input.

The pliable member preferably defines an interior within which the one or more passages are formed. The passages open onto open end areas that establish communication between adjacent passages. The heating elements in each pair of adjacent passages define a connector portion located in one of the open areas, such that the heating elements are preferably formed of a single length of heating wire that extends back and forth within the passages throughout the area of the pliable member. The heating wire defines a pair of ends, which are secured to a heating wire connector mounted to a circuit board, which in turn has a connector for receiving power from a power supply. In a preferred form, the heating wire in each passage has a wave-type or sinusoidal configuration throughout the extent of the passage.

The invention contemplates a heating device having a heating element arrangement as set forth above, as well as an improvement in a heating device having a pliable member and a method of positioning heating elements within an interior defined by a pliable member, substantially in accordance with the foregoing summary.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings.

DETAILED DESCRIPTION OF THE INVENTION

Figure 1:
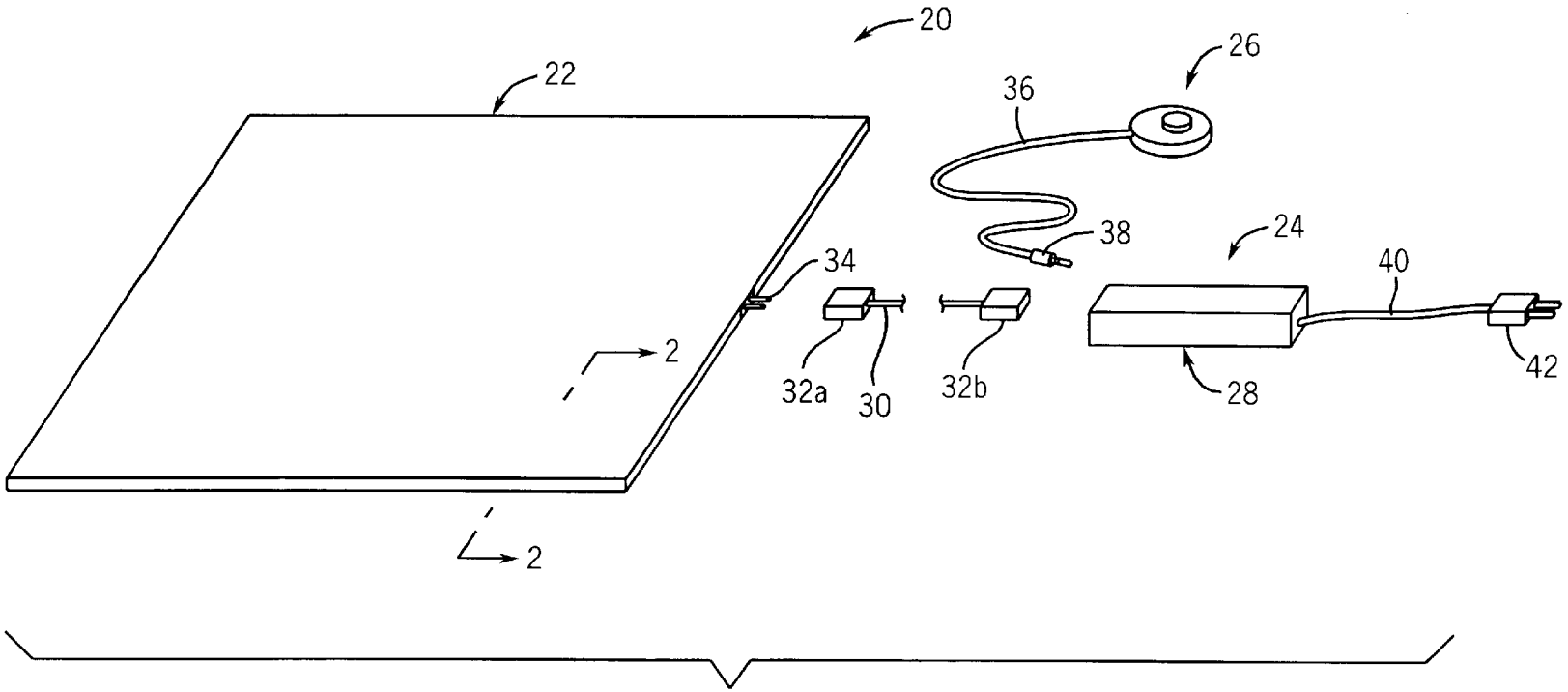
FIG. 1 is an isometric view illustrating an electrically operated heating device, such as an electric blanket, mattress pad, heating pad or throw, incorporating the heating element arrangement of the present invention.

Referring to FIG. 1, an electrically operated heating device, which may be an electric blanket, heating pad, mattress pad, or throw shown generally at 20, consists of a pliable member generically designated as a blanket portion 22, a power supply 24 and a controller 26. Power supply 24 includes a housing 28 within which the components of power supply 24 are contained. A connection cable 30 has a connector 32*a* at one end and a connector 32*b* at the opposite end. Connector 32*a* is adapted for engagement with a power input associated with blanket portion 22, which may representatively include a pair of power input connection prongs 34. Power supply 24 includes a power output receptacle with which connector 32*b* is adapted to be engaged, such that cable 30 communicates power from power supply 24 to blanket portion 22. Similarly, controller 26 includes a connection cable 36 having a connector 38 at its opposite end adapted for selective engagement with a control receptacle incorporated in power supply 24. A power input cord 40 extends from power supply 24, and includes a plug 42 at its end for engagement with a wall outlet or the like, to supply conventional 110 VAC 60 Hz power to power supply 24.

Power supply 24 may representatively have a construction and operation as shown and described in co-pending application Ser. No. 10/269,189, filed Oct. 11, 2002, the disclosure of which is hereby incorporated by reference. Power supply 24 converts the 110 VAC input power from power supply cord 40 into low voltage output power that is supplied to blanket portion 22 through cable 30, as well as to controller 26 through cable 36, for controlling the operation of power supply 24 to control the output of power to blanket portion 22.

Figure 2:
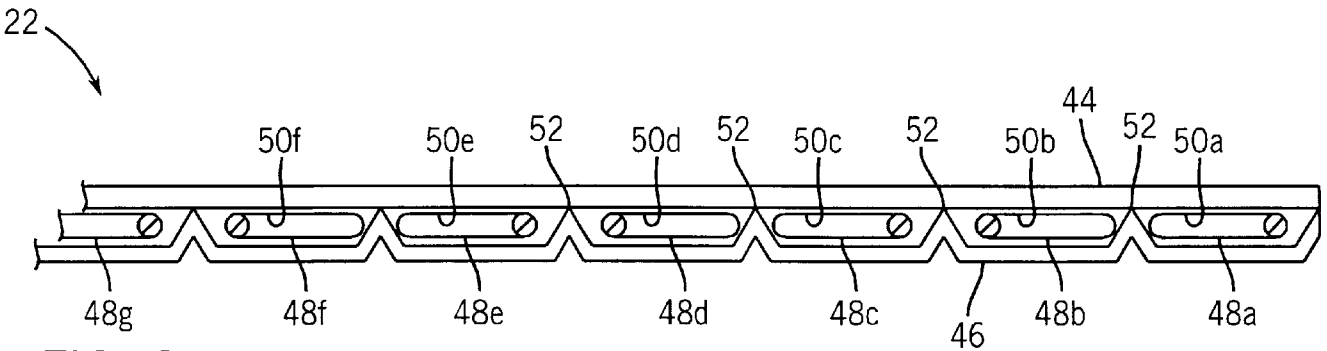
FIG. 2 is a partial section view taken along line 2—2 of FIG. 1, showing a first embodiment for positioning the heating elements into the interior of a pliable member forming a part of the electrically operated device.

Referring to FIG. 2, blanket portion 22 may have a construction including a top layer 44 and a bottom layer 46. A series of heating elements 48*a*, 48*b*, 48*c*, 48*d*, etc. are located between top layer 44 and bottom layer 46. Heating elements 48*a*, 48*b*, 48*c*, 48*d*, etc. are contained within respective longitudinal passages 50*a*, 50*b*, 50*c*, 50*d*, etc., which are formed by spaced apart linear connections 52 between top layer 44 and bottom layer 46. Passages 50*a*, 50*b*, 50*c*, 50*d*, etc. are all parallel to each other, and may either run in a lengthwise or crosswise direction throughout the area of blanket portion 22.

Figure 3:
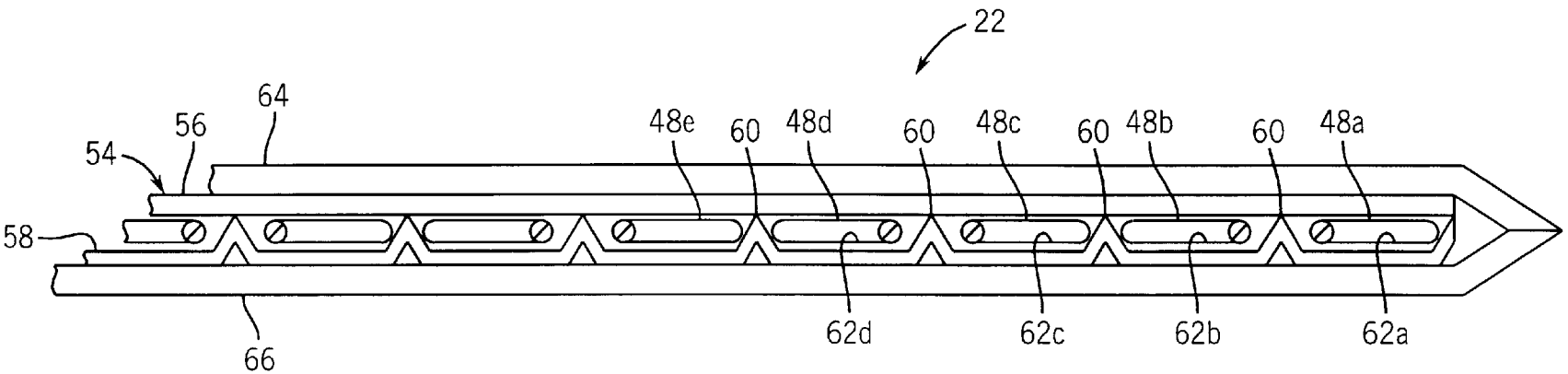
FIG. 3 is a view similar to FIG. 2, showing another embodiment for incorporating the heating element arrangement of the present invention into the pliable member forming a part of the electrically operated heating device.

In an alternative construction as shown in FIG. 3, heating elements 48*a*, 48*b*, 48*c*, 48*d*, etc. are contained within a carrier member 54, which includes a top layer 56 and a bottom layer 58 that are connected at spaced apart linear connections 60 to form separate parallel passages 62*a*, 62*b*, 62*c*, 62*d*, etc. within which heating elements 48*a*, 48*b*, 48*c*, 48*d*, etc. are contained. Carrier 54 is located between a top layer 64 and a bottom layer 66 of blanket portion 22, which define edges that are connected together to enclose carrier 54. In this manner, carrier 54 is prefabricated and heating elements 48*a*, 48*b*, 48*c*, 48*d*, etc. are assembled into blanket portion 22 simply by assembling carrier 54 between blanket portion layers 64 and 66.

In either the embodiment of FIG. 2 or the embodiment of FIG. 3, the connections such as 52, 60 between the layers within which the passages are defined, may be made in any satisfactory manner, such as by stitching, ultrasonic bonding, etc.

Figure 4:
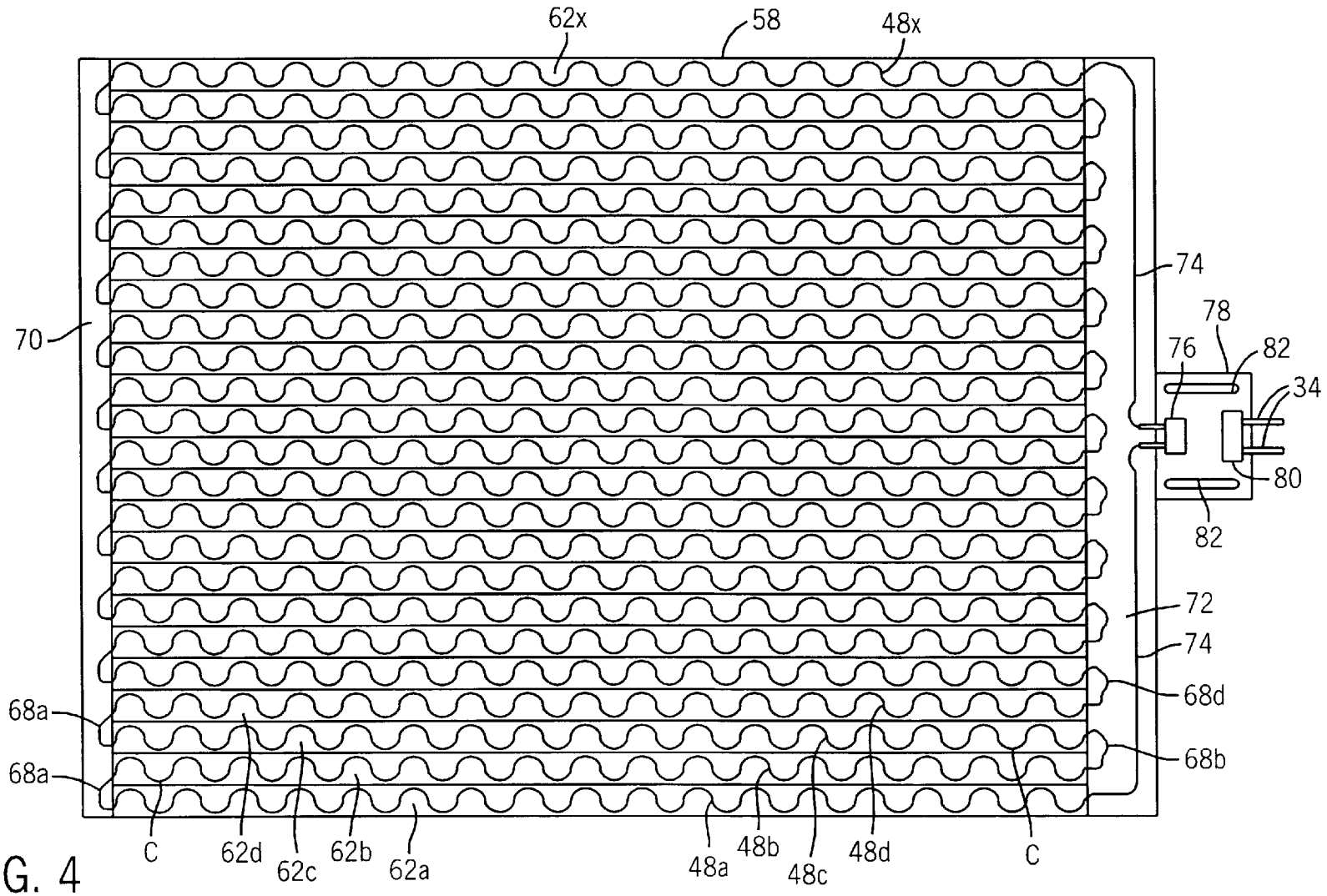
FIG. 4 is a plan view showing the arrangement of the heating elements incorporated in the pliable member forming a part of the electrically operated heating device of FIG. 1.

FIG. 4 illustrates the arrangement of heating elements 48*a*, 48*b*, 48*c*, 48*d*, etc. within blanket portion 22 in accordance with the present invention. FIG. 4 illustrates carrier 54 with top layer 64 removed. The areas of bottom layer 66 that are destined to be connected to top layer 64 are shown at C, to illustrate passages 62*a*, 62*b*, 62*c*, 62*d*, etc.

Heating elements 48*a*, 48*b*, 48*c*, 48*d*, etc. extend throughout the length of respective passages 62*a*, 62*b*, 62*c*, 62*d*, etc. Each heating element has a non-linear configuration as positioned within its respective passage, such that the overall length of the heating element exceeds that of the passage within which the heating element is located. In the illustrated embodiment, the heating elements have an undulating or sinusoidal wave-type configuration. It is understood, however, that any other satisfactory non-linear configuration may be employed, e.g. a zigzag configuration, a loop configuration, etc.

The heating elements 48*a*, 46*b*, 48*c*, 48*d*, etc. are all formed of a single length of heating wire, which representatively may be a _ gauge wire formed of a material such as _, which has been found to provide a satisfactory resistive load to generate heat throughout the area of blanket portion 22 when supplied with low voltage electrical power from power supply 24. It is understood, however, that any type of electric blanket heating wire of any gauge may be used, in a manner as is known.

Each part of adjacent heating elements are connected together at one end, such that a single length of wire is used throughout the area of blanket portion 22. For example, heating element 48*a* is interconnected with heating element 48*b* by means of a connector 68*a* located outwardly of the ends of passages 48*a*, 48*b* and connection area C therebetween. Connector portion 68*a* defines a loop which is located in an open area 70 into which the passages 48*a*, 48*b*, 48*c*, 48*d*, etc. open, which establishes communication between the adjacent passages. In a similar manner, the opposite end of heating element 48*b* is connected to the adjacent heating element 48*c* via a connector portion 68*b* which extends between and interconnects the ends of heating elements 48*b* and 48*c*. Connector portion 68*b* defines a loop that is located outwardly of the end of the connection area C between passages 62*b* and 62*c*, and is located in an open area 72 into which the opposite ends of passages 62*a*, 62*b*, 62*c*, 62*d*, etc. open, which establishes communication between the adjacent passages.

The end heating elements, shown at 48*a* and 48*x*, have lead sections 74 that are connected to a heating wire connector 76 mounted to a PCB junction box 78. A supply power connector 80 is also mounted to junction box 78, and includes power input prongs 34 that extend outwardly of blanket portion 22 for engagement with connector 32*a* of cable 30. Junction box 78 also includes a pair of stitch slots 82, which are adapted to receive stitch lines that connect top and bottom layers 64, 66, respectively, to maintain junction box 78 in position within the interior of blanket portion 22.

In operation, power that is supplied to the heating elements 48*a*, 48*b* . . . 48*x* through junction box 78 and heating wire connector 76 functions to generate heat within blanket portion 22. The arrangement of heating elements 48*a*, 48*b*, . . . 48*x* provides a uniform distribution of heat throughout the surface area of blanket portion 22, to prevent the presence of cool spots in blanket portion 22. In the event blanket portion 22 is subjected to a concentrated load, e.g. from the knee or elbow area of a user, the undulating or wave-type configuration of heating elements 48*a*, 48*b*, . . . 48*x* allow the heating element that is subjected to the load to stretch, so as to prevent the heating element from being exposed to tensile forces which otherwise could result in breaking of the heating element or disconnection from the power input. The presence of the loop connector portions such as 68*a*, 68*b*, which are located outwardly of the end edge of the wall that separates the passages within which the heating elements are received, accommodates such stretching of the heating element so as to prevent the connector portion from coming into contact with the end edge of the passage wall. In this manner, blanket portion 22 is capable of withstanding significant concentrated loads without any adverse effects on the heating elements, to prolong the life of blanket portion 22 and to maintain its continuous operation.

Various alternatives and embodiments are contemplated as being within the scope of the following claims particularly pointing out and distinctly claiming the subject matter regarded as the invention.

We claim:

1. A heating device, comprising:

a pliable member having first and second oppositely facing surfaces and defining a series of passages;

a connector member interconnected with the pliable member; and an elongated heating element located within each passage, wherein the elongated heating element in each passage has a non-linear configuration such that the overall length of the elongated heating element contained within the passage exceeds the length of the passage, so as to enable the heating element to flex and stretch in response to a tensile force applied to the heating element;

wherein the elongated heating elements located within the passages are defined by a series of sections of a continuous elongated heating member that defines a pair of ends, wherein each end of the continuous elongated heating member is interconnected with the connector member, wherein each adjacent pair of heating elements is interconnected via a connector section of the continuous elongated heating member.

2. The heating device of claim 1, wherein each passage is defined by a pair of generally parallel sides such that the passage has a substantially constant transverse dimension throughout its length, wherein the heating element is positioned within the passage so as to have a repetitive non-linear configuration having an axial component and a transverse component.

3. The heating device of claim 2, wherein the heating element has a wave configuration throughout the length of the passage.

4. A heating device, comprising:

a pliable member having first and second oppositely facing surfaces; and at least one elongated heating element located between the first and second oppositely facing surfaces, wherein the pliable member defines a series of passages and wherein an elongated heating element is located within each passage, wherein the elongated heating member in each passage has a non-linear configuration such that the overall length of the elongated heating member contained within the passage exceeds the length of the passage, so as to enable the heating element to flex and stretch in response to a tensile force applied to the heating element;

wherein each passage is defined by a pair of generally parallel sides such that the passage has a substantially constant transverse dimension throughout its length, wherein the heating element is positioned within the passage so as to have a repetitive non-linear configuration having an axial component and a transverse component; and wherein the pliable member defines an interior within which the series of passages are located, and wherein the interior of the pliable member further includes a pair of spaced apart open end areas, wherein the passages open to the open end areas and wherein the heating elements of adjacent passages include a connector portion located in one of the open areas that extends between and interconnects the heating elements in adjacent passages.

5. The heating device of claim 4, wherein the heating elements are defined by a length of heating wire that extends in a back and forth manner through the passages and the open areas.

6. The heating device of claim 5, wherein the heating wire includes a pair of end portions that extend through one of the open end areas and that are engaged with a connector member secured to the pliable member.

7. The heating device of claim 6, wherein the pliable member is formed of a fabric material and wherein the heating device comprises an electrically operated blanket, heating pad or throw.

8. In an electrically operated heating device including a pliable member having an interior within which one or more elongated heating elements are located, the improvement comprising one or more passages within the interior of the pliable member, wherein an elongated heating element is located within each passage and is configured such that the heating element has a non-linear wave-type configuration and defines an overall length greater than a length defined by the passage, to alleviate stress on the heating element resulting from application of a tensile force to the heating element, wherein the interior of the pliable member includes a pair of open end areas between which the passages extend, wherein a pair of adjacent heating elements include a connector portion located in one of the open end areas that extends between and interconnects the pair of adjacent heating elements.

9. The improvement of claim 8, wherein the adjacent passages are separated by a wall having an edge that borders one of the open end areas, and wherein the connector portion of the pair of adjacent heating elements extends into the open end area outwardly of the wall edge so as to define an end loop that prevents engagement of the connector portion with the wall edge when a tensile force is applied to one of the adjacent heating elements.

10. The improvement of claim 8, wherein the pliable member comprises a first layer and a second layer, wherein the second layer is connected to the first layer in spaced apart locations such that open areas between the connections between the first and second layers define the passages within which the heating elements are located.

11. In an electrically operated heating device including a pliable member having an interior within which one or more elongated heating elements are located, the improvement comprising one or more passages within the interior of the pliable member, wherein an elongated heating element is located within each passage and is configured such that the heating element has a non-linear configuration and defines an overall length greater than a length defined by the passage, to alleviate stress on the heating element resulting from application of a tensile force to the heating element, wherein the pliable member comprises a carrier member defining first and second layers that are interconnected together so as to define the passages between the first and second layers, and further comprising a pair of outer layers between which the carrier member is located.

12. A method of positioning one or more elongated heating elements within an interior defined by a pliable member forming a part of an electrically operated heating device, comprising the steps of dividing the interior of the pliable member into separate passages, non-removably placing each heating element within one of the passages in the interior of the pliable member, wherein the heating elements are placed such that each heating element has a non-linear configuration and a length greater than that of the passage, to alleviate stress in the heating element resulting from tensile forces applied to the heating element, and enclosing the heating elements within the separate passages.

13. The method of claim 12, wherein each heating element is placed within the passage such that the heating element has a wave-type configuration.

14. The method of claim 13, wherein the step of placing the heating elements within the passages is carried out by connecting each heating element at one of its ends to an adjacent heating element via a connector portion located outwardly of the passages within which the adjacent heating elements are located.

15. A method of positioning one or more elongated heating elements within an interior defined by a pliable member forming a part of an electrically operated heating device, comprising the steps of:

placing each heating element within a passage associated with the interior of the pliable member such that each heating element has a non-linear wave-type configuration and a length greater than that of the passage, to alleviate stress in the heating element resulting from tensile forces applied to the heating element; and connecting each heating element at one of its ends to an adjacent heating element via a connector portion located outwardly of the passages within which the adjacent heating elements are located wherein the step of placing the heating elements within the passages is carried out such that the heating elements are formed of a single length of heating wire positioned such that the connector portions between adjacent sections of the heating wire located within adjacent passages are located outwardly of the passages within an open area that establishes communication between the adjacent passages.

16. A heating device, comprising:

a pliable member having first and second layers that define oppositely facing surfaces, wherein the first and second layers extend between spaced apart closed ends and define a series of internal passages that extend between the spaced apart closed ends; and a series of elongated heating elements, wherein each heating element is non-removably disposed within one of the passages, wherein the elongated heating element in each passage has a non-linear configuration such that the overall length of the elongated heating element contained within the passage exceeds the length of the passage, so as to enable the heating element to flex and stretch in response to a tensile force applied to the heating element.

17. The heating device of claim 16, wherein the elongated heating elements located within the passages are defined by a series of sections of a continuous elongated heating member that defines a pair of ends, wherein each end of the continuous elongated heating member is interconnected with a connector member interconnected with the pliable member, wherein each adjacent pair of heating elements is interconnected via a connector section of the continuous elongated heating member.

* * * * *